US005193604A

United States Patent [19]

Brugger

[11] Patent Number: 5,193,604

[45] Date of Patent: Mar. 16, 1993

[54] PROCESS FOR CENTRIFUGAL CASTING OF COPPER AND COPPER ALLOYS

[76] Inventor: Gottfried Brugger, A-5503 Mitterberghütten, Werksgelände 5, Austria

[21] Appl. No.: 659,302

[22] PCT Filed: Nov. 20, 1989

[86] PCT No.: PCT/AT89/00105

§ 371 Date: May 8, 1991

§ 102(e) Date: May 8, 1991

[87] PCT Pub. No.: WO90/06196

PCT Pub. Date: Jun. 14, 1990

[30] Foreign Application Priority Data

Nov. 28, 1988 [AT] Austria ..... 2915/88

[51] Int. Cl.[5] ..... B22D 13/02; B22D 13/10

[52] U.S. Cl. ..... 164/56.1; 164/114

[58] Field of Search ..... 164/56.1, 114, 72, 473, 164/270.1, 298, 299, 300, 301

[56] References Cited

U.S. PATENT DOCUMENTS

| | | | |
|---|---|---|---|
| 1,963,147 | 6/1934 | Russell et al. | 164/300 X |
| 1,963,149 | 6/1934 | Russell et al. | 164/300 X |
| 2,262,184 | 11/1941 | Ireton, Jr. | 164/299 X |
| 2,265,740 | 12/1941 | Morgan | 164/56.1 |
| 3,563,300 | 2/1971 | Honda et al. | 164/114 X |
| 4,095,643 | 6/1978 | Farlow et al. | 164/114 X |
| 4,632,172 | 12/1986 | Etienne et al. | 164/114 X |

FOREIGN PATENT DOCUMENTS

| | | | |
|---|---|---|---|
| 483373 | 10/1929 | Fed. Rep. of Germany . | |
| 1296750 | 6/1969 | Fed. Rep. of Germany . | |
| 2254705 | 2/1975 | Fed. Rep. of Germany . | |
| 2422339 | 11/1976 | Fed. Rep. of Germany . | |
| 2823173 | 12/1978 | Fed. Rep. of Germany . | |
| 1089532 | 10/1959 | France | 164/300 |
| 2481624 | 11/1981 | France . | |
| 1391799 | 4/1988 | U.S.S.R. | 164/299 |

OTHER PUBLICATIONS

Abstract of Japanese Patent Publication 56-151157 published Nov. 24, 1981.

*Primary Examiner*—J. Reed Batten, Jr.

*Attorney, Agent, or Firm*—Salter, Michaelson & Benson

[57] ABSTRACT

A process for the centrifugal casting of copper, copper alloys, or other oxygen sensitive alloys, such as bronze, is effective for avoiding or reducing the formation of an oxide layer on the inner surface of the casting. The process essentially consists of applying powdered borax in a layer thickness of 0.5 mm to 4 mm onto the still liquid inner surface of the casting immediately after pouring the casting. The preferred thickness of the borax is 1 mm to 3 mm. Finely divided mixtures of metals which have an affinity for oxygen, such Mg, Li, Ce, and/or powders of graphite and/or fire clay and/or charcoal, can also be combined with the borax as additional additives for special casting processes. Apparatus for introducing the borax into the mold includes a trough which is extendable into the interior of the mold. The trough is either rotatably supported in a housing that is movable relative to the mold, or pivotally supported along a bottom portion of a pouring tube which is movable relative to the mold.

4 Claims, 2 Drawing Sheets

PROCESS FOR CENTRIFUGAL CASTING OF COPPER AND COPPER ALLOYS

BACKGROUND OF THE INVENTION

Figure 1:
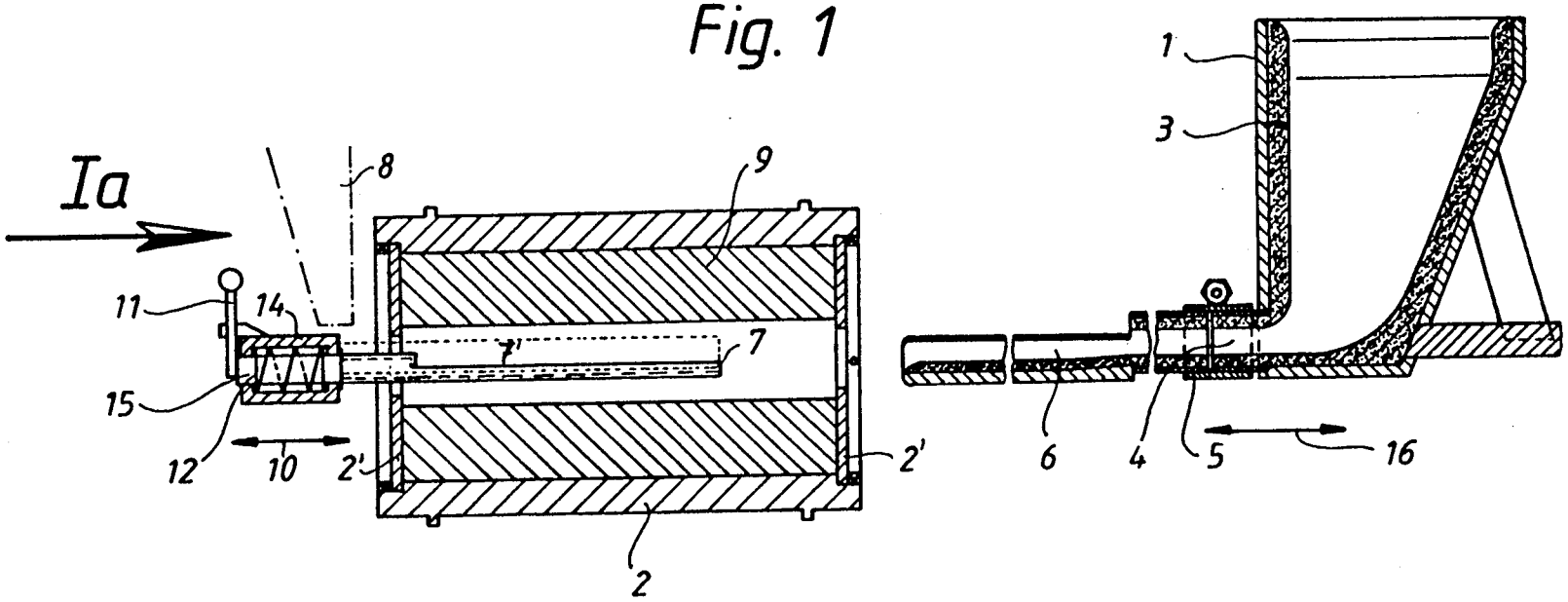

The invention relates to a process for centrifugal casting copper, copper alloys, or other alloys, wherein, in order to reduce or, respectively, avoid the oxide layer that forms on the inner surface of the casting at least one additive is introduced into the mold. In addition, the present invention relates to an apparatus for centrifugal casting copper or copper alloys with a rotatable mold a pouring tube and a delivery means for additives, that, in addition to the pouring tube, leads or can be led into the mold, particularly into the interior of the casting.

The use of borax as a flux is generally known. Further, the addition of borax is known from the US-PS 2,265,740 for centrifugal casting of iron to tubes of cast iron; in this case borax is blown onto the inner surface of the molded tubes. The DE-OS 2,422,339 describes the addition of fluxes, for example common salt, cryolite, fluorite, sodium silicate, in the centrifugal casting of iron and non ferrous metals. Further, DE-AS 1,296,750 relates to the addition of liquid borax-lime-soda-window glass-mixtures when centrifugal casting iron, wherein, these mixtures have been heated to a temperature above the temperature of the iron melt. An apparatus similar to initially mentioned kind is usual for the delivery of additives, and is known from FR-A 2,481,624 or, JP-A 56-131,157. When producing centrifugal castings of copper or copper alloys, an oxidation layer forms on the inner surface of the castings as a result of oxidation, which layer must be turned out. The thickness of this oxidation layer depends in particular, on the wall thickness of the casting and from the amount of oxygen that is absorbed during the casting process and during cooling. A disturbing oxidation layer of considerable thickness is formed even at relatively thin wall thicknesses of approximately 15 to 20 mm, and this increases in proportion to the wall thickness. In the case of thicker castings, the thickness of this layer, which has to be turned off, can amount to up 15% of the wall thickness. The thickness of this oxidation layer is, in particular, affected by the cooling speed of the melt and the length of time during which the melt on the inner surface of the casting retains higher temperature since atmospheric oxygen has an unfavourable effect and affects the thickness of the oxide layer that forms on the inside surface.

DESCRIPTION OF THE INVENTION

According to the invention a process of the kind initially mentioned, by which process these disadvantages can be avoided, is characterized in that powdered borax is applied as an additive immediately after pouring the melt into the mold onto the particularly still liquid inner surface of the casting, if desired in conjunction with finely divided mixtures of metals that have an affinity for oxygen and/or powders of graphite and/or fire-clay and/or charcoal, with a layer thickness of 0.5 to 4 mm. After introducing the additive forming the layer, the mold with the casting is further rotated and is cooled with water. The introduction of borax after the melt has been poured substantially prevents the formation of an undesired layer of oxidation and reduces the transfer of heat, thus maintaining the flowability of the metal on the inner surface and enhancing the so-called post-drawing effect (subsequent flow of the still flowable metal during solidifying) during the hardening process. It has been shown that a considerable reduction of the previously required internal addition of approximately ¼ overmeasure could be achieved. Thereby, in most instances, the castings that are produced do not require preliminary turning and, also in the case of thicker wall thicknesses, it is provided a possibility of being able to produce castings of this kind at a premachining quality. This results in considerable savings in labour, materials and weight which are accompanied by a considerable reduction of the costs.

With regard to the statements on page 10, fourth paragraph of the DE-OS 2 422 339, the additives are to be discharged simultaneously with the melt. The additives that are described and the common introduction of melt and additives into the mold, are, however, detrimental to an even overall casting structure in the case of non-ferrous heavy metals; in addition, an improved protection against oxidation and a far superior surface structure can be achieved by the addition especially of borax, if desired, together with the further additives added according to the invention, in comparison with the procedure known from this DE-OS. The addition of borax, as described by the invention, to the metal surface that has just been formed and that is still liquid, in the said layer thickness, makes it possible to form a surface that is free from shrinkholes and faults and that can be turned to size without any intermediate processing. Because of the relatively rapid cooling, in particular of thin-walled centrifugal castings and because of the small differences in the specific weights of the melt and the additives, the common pouring, or introduction of the melt and the additives into the cold mold leads to the possibility that because of a lack of time the additives may not float to a sufficient extent in the melt until solidification begins, so that the additives are distributed throughout the cold mass. Very often, in the case of thin-walled objects this leads to castings that are unusable. Borax has the advantage that it shows a very pronounced tendency to remain distributed on the surface of the melt.

It is further to be noted within the inventive procedure that the use of borax in connection with copper and copper alloys has heretofore been avoided in practice by those skilled in the art because copper borides are formed which decidedly detrimentally adversely affect the structure of the copper alloys. The formation of borides in other metals, for example in connection with iron melts, is not so grave, because within iron alloys carbon-bore compounds are formed which favourably influence the structure. In contradiction thereto, when centrifugal casting, there was a prejudice among experts against the use of borax insofar as, on the one hand, the addition of borax at low temperatures was considered to be relatively effectless, and therefore the addition of protective agents at temperatures near the melt temperature was recommended and on the other hand, the addition of borax was refused on the grounds of the formation of borides.

According to the invention, however, it has been shown that the addition of powdered borax in the mentioned layer thickness, was sufficient to form the surface of the casting free of oxides and simultaneously to substantially avoid the formation of borides. Simultaneously, because of the borax layer the flowability of the metal melt near the inner space of the casting was retained; if the mold is in the usual manner cooled with water, cooling proceeds quickly and thereby the formation of detrimental boride compounds is also avoided. The thin layer of the borax applied according to the invention is just sufficient to prevent oxidation and to keep the formation of borides below undesired secondary effects.

Of particular importance for the man skilled in the art, however, is the instruction to which amount the borax is to he applied onto the inner surface of the casting in order to avoid on the one hand an oxidation and on the other hand the formation of borides; it is sufficient to calculate the amount of the borax to be applied in dependence on the desired inner surface of the casting and to coat the inner surface therewith.

If immediately after the melt has been poured, the layer of borax is formed onto the inner surface of the casting with a thickness of 1 to 3 mm, the applied borax melts quickly at the temperatures given and a layer of this thickness is sufficient to bind the oxygen that is absorbed by the alloy during the pouring process and to prevent the formation of an oxide layer. Simultaneously, there is sufficient protection against atmospheric oxygen. There is no negative effect on the structure of the object.

If the borax, optionally together with the mixtures, is applied in powdered form, it evenly distributes over the inner surface of the casting during the further rotation of the mold with the casting. If borax and mixtures having a low heat-transfer capability are used, the surface quality of the inner surface is further improved, since during the solidification subsequent movement of the metal that can still flow is possible on the inside surface for a longer time.

The quantity or, respectively, the layer thickness, at which borax and, optionally, the mixtures are introduced, is determined by the thickness of the work piece and by the diameter of the bore or, respectively, of the hollow volume of the workpiece.

For special casting processes it can be of advantage to apply Mg, Li or Ce as metals that have an affinity to oxygen.

According to the invention an apparatus for the centrifugal casting of copper or copper alloys is characterized in that the discharge means is a trough that is so supported as to be tiltable around its longitudinal axes, or respectively swivellable around its longitudinal extension, in particular its longitudinal edge, into the discharge position. The trough is preferably tiltable or swivellable against the action of a spring. The trough is rotatably supported around its longitudinal axis in a carrier, or respectively a housing which is movable relative to the mold. Alternatively, the trough is swivellably supported around its longitudinal axis on the pouring tube that is moved into and out of the mold. This discharge means is simply constructed and enables one to introduce the additives that have to be introduced into the mold without effort. In principle, it is possible to introduce the borax or, respectively, the mixtures also by hand, for example by means of a shovel, however metering by the discharge means is more precise and the arrangement of such discharge means is advantageous, particularly in an automated pouring operation. Particular advantage of this apparatus is the possibility of equal and simultaneous introduction over the total length of the mold.

The invention is further directed to the use of powdered borax for application in a layer thickness of 0.5 to 4 mm, preferably 1 to 3 mm, onto the (inner)surface of workpieces produced by centrifugal casting, immediately following the casting of the melt of copper, copper alloys, in particular bronze. This use of borax is new and results in the effects described above.

Figure 1A:
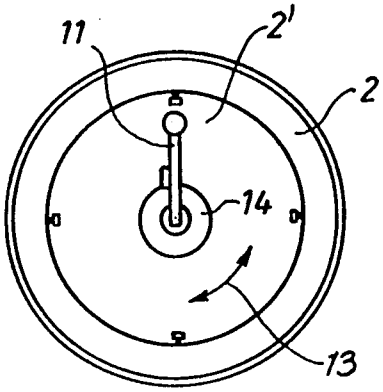
Figure 2:
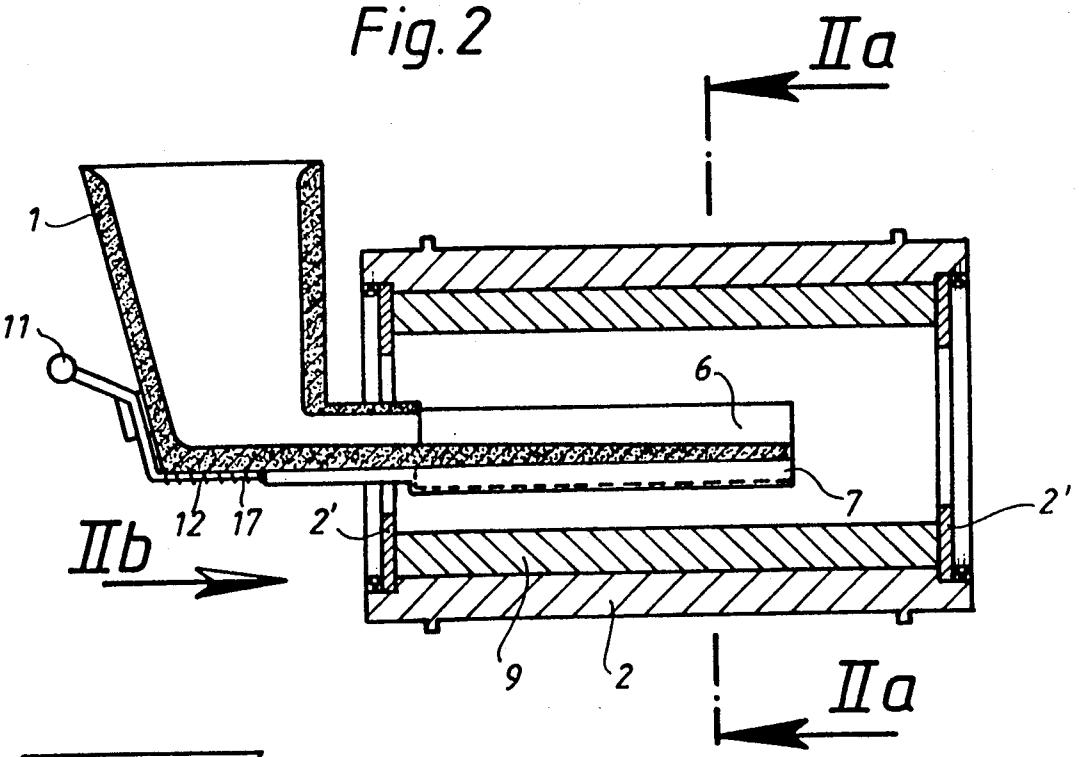
Figure 2A:
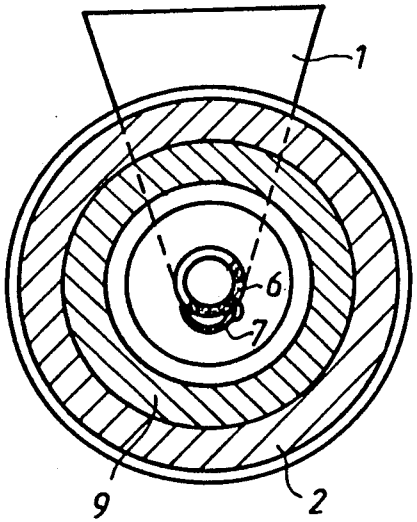
Figure 2B:
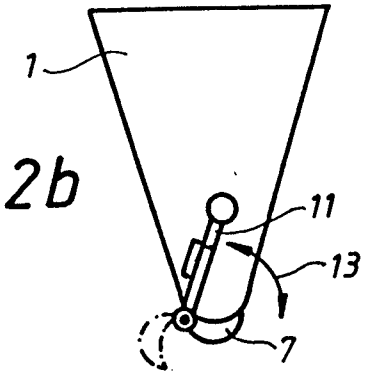

The invention is explained more in detail by way of the following embodiments of the inventive apparatus as shown schematically in the drawings, in which;

FIG. 1 is a cross sectional view of the apparatus of the instant invention;

FIG. 1*a* is an elevational end view thereof taken along line Ia of FIG. 1;

FIG. 2 is a cross sectional view of a second embodiment of the apparatus of the instant invention;

FIG. 2*a* is a side sectional view thereof taken along line 11*a*—11*a* of FIG. 2; and FIG. 2*B* is an elevational end view thereof taken along line 11*b* of FIG. 2.

According to FIG. 1, a discharge opening 4 of a melt container or, respectively, pouring funnel 1 having a fire clay lining 3 is connected by a shell 5 with a pour spout 6 that is open at the front and above or, respectively, at the side to permit the melt to escape, and can be introduced into a mold 2 according to arrow 16. On that side of the mold 2 having end walls 2', that is remote from the pouring funnel 1, there is provided a discharge means 7, comprising a trough which can be tilted around its longitudinal extension and which can be moved into and out of the mold 2 in the direction of the arrow 10. In the position moved out, the trough can be supplied by hand or from an indicated supply container 8 when either retracted or extended, with borax and optionally finely divided mixtures of metals that have an affinity for oxygen and/or powders of graphite and/or fire clay and/or charcoal. The introduction or, respectively, the feed of borax or, respectively, of the mixture onto the casting 9 is started immediately after ending of the introduction of the melt or, respectively, after the pouring tube has been moved out. Once the casting 9 has so far cooled that a further oxidation or, respectively, formation of an oxide layer on the inner surface can no longer occur, the casting 9 is removed from the mold and is finished by being turned.

FIG. 1 shows a side view of the inventive apparatus. In FIG. 1 and 1*a* a handle 11 is shown by which the trough 7 can be swivelled in the direction of the arrow 13 against the action of a spring 12. In this regard, the end section 15 of the trough 7 is rotatably supported in housing 14 which also accommodates the spring 12. The trough 7 extends at least to the center of the casting 9, preferably to a point near the opposite edge of the casting 9. The arrangement shown in FIG. 1 and 1*a* can be used, in particular, if the inside diameter of the casting is relatively small and the pouring tube 6 and the trough 7 cannot be accommodated together. It is possible to dispose the melt container or, respectively, the pouring funnel 1 with the pouring spout 6 as well as the trough 7 stationarily and to pull off the casting 9 with the mold 2 from the pouring spout 6 and to slide it onto the trough 7; in this case only the mold is to be moved.

By dashed lines the possibility is indicated in FIG. 1 to cover the open surface of the trough 7 by means of a trough-shaped or, respectively, half-dish shaped cover screen 7' that is secured to the housing 14. In the event that the trough 7 and the pouring spout 6 are introduced simultaneously into the mold during casting, metal is prevented from entering the trough 7. In order to discharge the powder, the trough 7 is pivoted beneath the cover screen 7'. In FIG. 2, the pouring spout 6 assumes the function of the cover screen 7'.

FIG. 2 shows an inventive apparatus in which the trough 7 is combined with the pouring spout 6. This arrangement saves space and can be used, in particular, in the case of castings 9 having a somewhat greater inner diameter. The trough 7 is pivotably supported relative to the pouring tube 6, for example by means of bearings and trunnions, on the pouring tube 6 about its longitudinal dimension or, respectively, longitudinal edge; by means of a shaft 17 that, for example, is bearingly supported on the melt funnel 1, the trough is connected to the handle 11 which can be adjusted against the action of the spring 12, which spring 12 presses the trough 7 into the closed position, that means engaging the pouring tube 6, as shown in FIG. 2*a*. The trough 7 is charged when it is extended. This apparatus has the advantage that the borax or, respectively, the mixtures can be supplied immediately after the end of introduction of the melt.

Instead of the handle 11 it is also possible to provide mechanical handling means. The cross sectional shape of the trough can be as desired.

In the following the invention is explained by way of an example:

By centrifugal casting a blank piece of red brass as per DIN 1705, melt composition Gz-Rg 7, having 172 mm outer diameter and 134 mm inner diameter, at a length of 460 mm is to be produced and is intended for the production of a sliding bearing. The horizontally bearingly supported steel mold was preheated to about 150° C. After the mold had been closed, a casting device was disposed centrally, the egress opening of the pouring funnel is matched to the casting mass and had a diameter of 28 mm. A casting trough was connected to the pouring funnel which extends over two third of the length of the mold and extends substantially horizontally therein. By means of this casting process the melt that has been weighed and heated to 1150° C. was so cast, as the peripheral speed of the inner wall of the mold was increased to 7 m/s, the casting funnel remained filled with melt having a bath surface level of about 200 mm, whereby a constant throughput and an equal distribution of the melt by means of the pouring spout within the mold is ensured. The casting time amounts to about four seconds. Thereafter, the casting apparatus was removed and the mold was cooled with water, whereupon, after the blank piece has been solidified, this blank piece was removed from the mold. Immediately after the end of the supply of the melt, borax was added by hand into the mold in a quantity such that a layer of molten borax formed on the inner surface of the blank piece, this layer having a thickness of about 1 mm. The formation of any notable layer of oxide on the inner surface was prevented; the normal irregularities of the cast wall could be removed during the course of main turning work so that the expected preliminary turning off of the oxide layer could be eliminated.

The dimensions of the castings which can be produced by the inventive process can be widely varied; for example, 50 mm length and tubes of, for example, short rings of 2000 mm length can be produced in the same manner.

I claim:

1. A process for reducing the formation of an oxide layer on an inner surface of a copper or copper alloy casting during the centrifugal casting thereof, said process comprising the steps of:

applying powdered borax as an additive onto a still liquid inner surface of said casting immediately after pouring said casting in a rotating casting mold, said borax being applied in a thickness of approximately 0.5 mm to 4.0 mm; and further rotating said casting mold.

2. The process according to claim 1 further comprising the step of introducing at least one additional additive in conjunction with said borax, said additive being taken from a group consisting of finely divided mixtures of metals having an affinity for oxygen, powdered graphite, powdered fire-clay, and powdered charcoal.

3. A process for reducing the formation of an oxide layer on an inner surface of a copper or copper alloy casting during the centrifugal casting thereof, said process comprising the steps of:

applying powdered borax as an additive onto a still liquid inner surface of said casting immediately after pouring said casting in a rotating casting mold, said borax being applied in a thickness of approximately 0.5 mm to 4.0 mm;

introducing at least one additional additive in conjunction with said borax, said additional additive being taken from a group consisting of finely divided mixtures of metals having an affinity for oxygen, powdered graphite, powdered fire-clay and powdered charcoal, said metals having an affinity for oxygen comprising Mg, Li and Ce; and further rotating said mold.

4. A process for reducing the formation of an oxide layer on an inner surface of a copper or copper alloy casting during the centrifugal casting thereof, said process comprising the steps of:

applying powdered borax as an additive onto a still liquid inner surface of said casting immediately after pouring said casting in a rotating casting mold, said borax being applied in a thickness of approximately 1.0 mm to 3.0 mm; and further rotating said mold.

* * * * *